US006157777A

United States Patent [19]

Banks et al.

[11] Patent Number: 6,157,777

[45] Date of Patent: Dec. 5, 2000

[54] HEATER ASSEMBLY FOR A FLUID CONDUIT WITH AN INTEGRAL HEATER

[75] Inventors: Frank Banks, Granger; Michael Persinger, Syracuse, both of Ind.

[73] Assignee: Dekko Heating Technologies, Inc., North Webster, Ind.

[21] Appl. No.: 09/130,180

[22] Filed: Aug. 6, 1998

[51] Int. Cl.[7] ..... F24H 1/10; H05B 3/06

[52] U.S. Cl. ..... 392/480; 392/478; 219/536

[58] Field of Search ..... 392/480, 487, 392/465, 485, 473, 459, 501; 219/535, 536

[56] References Cited

U.S. PATENT DOCUMENTS

| | | | |
|---|---|---|---|
| 3,031,739 | 5/1962 | Boggs | 219/535 |
| 4,192,988 | 3/1980 | Pederson, Jr. et al. | 219/201 |
| 4,581,521 | 4/1986 | Grise | 219/535 |
| 5,434,388 | 7/1995 | Kralik et al. | 219/538 |

*Primary Examiner*—Teresa Walberg
*Assistant Examiner*—Thor Campbell
*Attorney, Agent, or Firm*—Taylor & Aust, P.C.

[57] ABSTRACT

A fluid transport assembly transports a fluid through a fluid conduit and maintains the fluid above a predetermined temperature. A fluid line carries the fluid therein. The heater assembly includes a body with a bore and two open ends respectively disposed at each end of the bore. The fluid line is disposed within the bore and contacts the body. The heater assembly further includes a heater and at least two electrical terminals connected with the heater. The heater is disposed within the body and each terminal extends from the body.

16 Claims, 3 Drawing Sheets

HEATER ASSEMBLY FOR A FLUID CONDUIT WITH AN INTEGRAL HEATER

BACKGROUND OF THE INVENTION

1. Field of the Invention

The present invention relates to a heater assembly, and, more particularly to a heater assembly used to maintain fluid within a fluid conduit at a predetermined elevated temperature.

2. Description of the Related Art

It is known to use a heater to maintain a fluid flowing within a conduit or pipe at a temperature above the freezing point of the fluid being transported. For example, it is known to wrap a heat tape around the periphery of a water pipe to inhibit the water within the pipe from freezing. The heat tape is typically held in place using adhesive tape, cable ties or other devices for suitably attaching the heat tape to the pipe. The heat tape includes a resistance heater wire therein which is operatively controlled using a bi-metal thermostatic switch.

A problem with using a conventional heat tape to heat a fluid within a fluid conduit or pipe is that the heat tape is disposed on the outside of the pipe and is susceptible to mechanical damage rendering the heat tape inoperable and/or causing an electrical shorting condition. Another problem is that such a conventional heat tape comes in standard lengths (e.g., 1 foot, 2 foot, 4 foot, etc.). An inexperienced user may wrap the heat tape in a spiral manner about the pipe in one direction, and if the end of the pipe is reached, reverse the spiral wrap direction of the heat tape such that the heat tape overlaps itself. Overlapping the heat tape may result in melting of the plastic which carries the heater wire, which in turn may result in an electrical shorting condition. Moreover, if the segment of fluid conduit or pipe is relatively short, a heat tape may not be commercially available which is short enough to wrap around the periphery of the pipe without the aforementioned problem associated with overlapping the heat tape.

What is needed in the art is a heater assembly which may be used to maintain a fluid flowing within a fluid conduit above a predetermined temperature. What is further needed in the art is a heater assembly for heating a fluid within a fluid conduit which is not susceptible to physical damage and which is always placed at the same location relative to the flowing fluid to eliminate installation errors by a user.

SUMMARY OF THE INVENTION

The present invention provides a heater assembly for maintaining a fluid within a fluid conduit at or above a predetermined temperature, wherein a heater which at least partially surrounds a flowing fluid is integrally molded within a body and only the electrical terminals connected with the heater extend from the exterior of the body.

The invention comprises, in one form thereof, a fluid transport assembly for transporting a fluid through a fluid conduit and maintaining the fluid above a predetermined temperature. A fluid line carries the fluid therein. The heater assembly includes a body with a bore and two open ends respectively disposed at each end of the bore. The fluid line is disposed within the bore and contacts the body. The heater assembly further includes a heater and at least two electrical terminals connected with the heater. The heater is disposed within the body and each terminal extends from the body.

An advantage of the present invention is that the heater is disposed within the body of the heater assembly and is thereby protected from physical damage.

Another advantage is that the heater is always placed at the same location relative to the fluid flowing within the fluid line, and thereby avoids installation errors by a user.

Yet another advantage is that the terminals which extend from the body may be easily connected with a suitable source of electrical power.

A further advantage is that the heater assembly includes a bore which may either directly carry the flowing fluid, or engage and carry a fluid line which in turn carries the flowing fluid.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
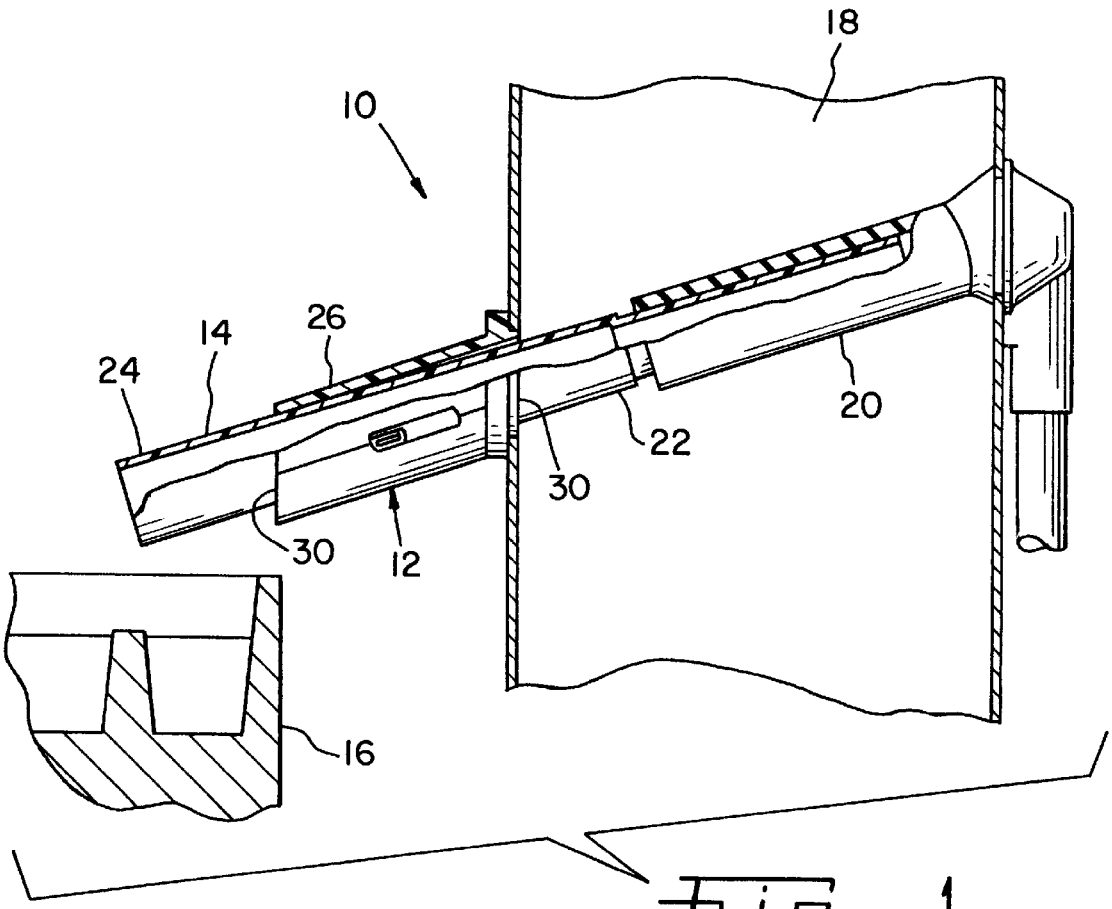
FIG. 1 is a side, sectional view of an embodiment of a fluid transport assembly of the present invention used in conjunction with an automatic ice maker in a freezer.

Referring now to the drawings, and more particularly to FIG. 1, there is shown an embodiment of a fluid transport assembly 10 of the present invention, including a heater assembly 12 which is placed around and heats a fluid line 14.

Fluid line 14 supplies water to an automatic ice maker unit 16 within an electric freezer. Fluid line 14 extends through a wall 18 of the freezer and is connected with a coupling 20 which receives water from a water supply (not shown). Fluid line 14 defines a fluid conduit which diverges slightly from an inlet 22 to an outlet 24.

Heater assembly 12 includes a body 26 with a bore 28 and two open ends 30 which are respectively disposed at each end of bore 28. Bore 28 has a size and shape which is complementary with fluid line 14 to thereby mate with and contact fluid line 14. More particularly, bore 28 has a taper which diverges at an angle which is complementary to the taper of fluid line 14. By providing both fluid line 14 and bore 28 with complementary tapers, it is possible to always locate fluid line 14 within bore 28 at the same axial position, thus ensuring that outlet 24 is always at the same location relative to automatic ice maker 16.

Figure 2:
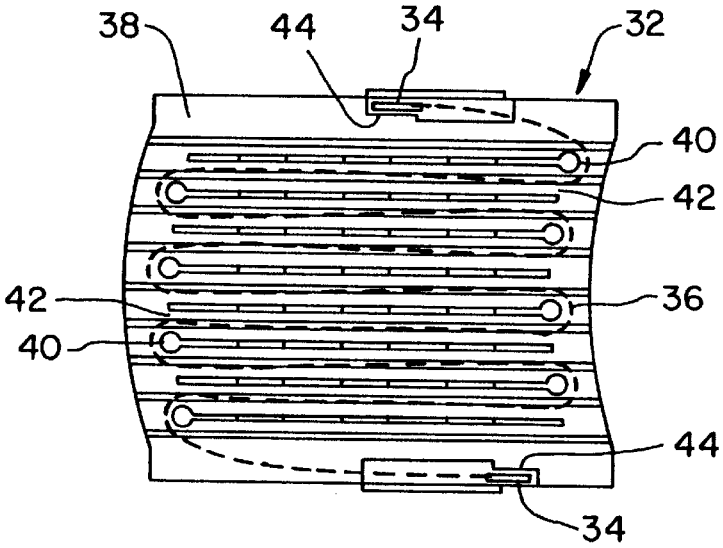
FIG. 2 is a plan view of the heater of the heater assembly of FIG. 1.
Figure 3:
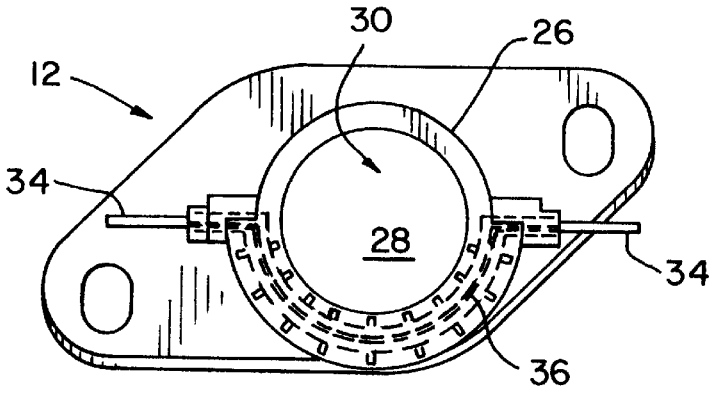
FIG. 3 is an end view of the heater assembly of FIG. 1.
Figure 4:
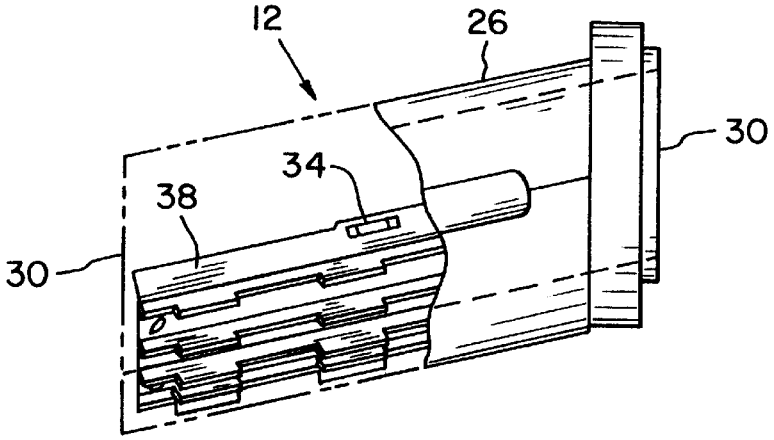
FIG. 4 is a fragmentary, side view of the heater assembly of FIG. 1.

Referring now to FIGS. 2–4, heater assembly 12 is shown and will be described in greater detail. Heater assembly 12 includes a heater 32 and two electrical terminals 34 which are connected therewith. Heater 32 is disposed within body 26 and terminals 34 extend from body 26, as will be described hereinafter. More particularly, heater 32, in the embodiment shown, is in the form of a resistance heater wire 36 which is carried by a tree 38. Tree 38 is an injection molded plastic part which includes pegs 40 and channels 42. Resistance heater wire 36 is wrapped in a zig-zag or serpentine manner about pegs 40 and is received within channels 42. The serpentine pattern which is shown has been found to be effective to provide sufficient heat output per unit area to ensure that the water within fluid line 14 does not freeze. Of course, it will be appreciated that depending upon the fluid to be heated and the actual heat output per unit length of the resistance wire used, the exact density and shape of the resistance wire over the area to be heated may vary for each application. Tree 38 also includes cutouts 44 which are sized and shaped to receive terminals 34 therein and hold terminals 34 at a proper orientation.

After resistance heater wire 36 and terminals 34 are placed on tree 38, heater 32 is placed within a mold cavity to properly maintain heater 32 at a desired orientation within the mold during a subsequent plastic injection molding process. FIGS. 3 and 4 illustrate the proper placement of heater 32 within body 26, with FIG. 4 being shown in partially broken phantom lines to better illustrate heater 32. It should be noted that heater 32 actually only heats the bottom half of fluid line 14 in the embodiment shown. This is because when the water flows through fluid line 14, freezing typically is not a problem. On the other hand, during periods of inoperation, the water droplets within fluid line 14 tend to collect at the bottom of fluid line 14 as a result of gravitational force. Heating the top of fluid line 14 thus is generally not necessary, and heating only the bottom half of fluid line 14 conserves electrical power.

During manufacture, heater 32 is constructed by placing resistance heater wire 36 and terminals 34 on tree 38 as described above. Assembled heater 32 is then placed within an injection mold cavity which is sized and shaped to define a remainder of body 26. The mold is then closed and plastic is injected within the mold to define body 26, and thereby overmold heater 32. After heater assembly 12 is removed from the mold, it may subsequently be slid over the inlet end 22 of fluid line 14. Because of the matching tapers between bore 28 and fluid line 14, only a predetermined amount of fluid line 14 will extend from heater assembly 12. Fluid line 14 and heater assembly 12 may then be installed within the freezer to supply water to automatic ice maker 16 without the difficultly of the water freezing within fluid line 14.

Figure 5:
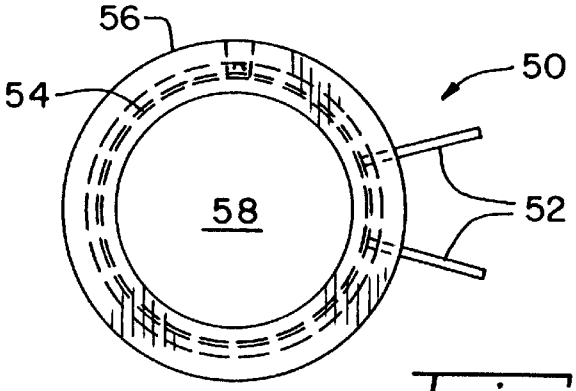
FIG. 5 is an end view of another embodiment of a heater assembly of the present invention.
Figure 6:
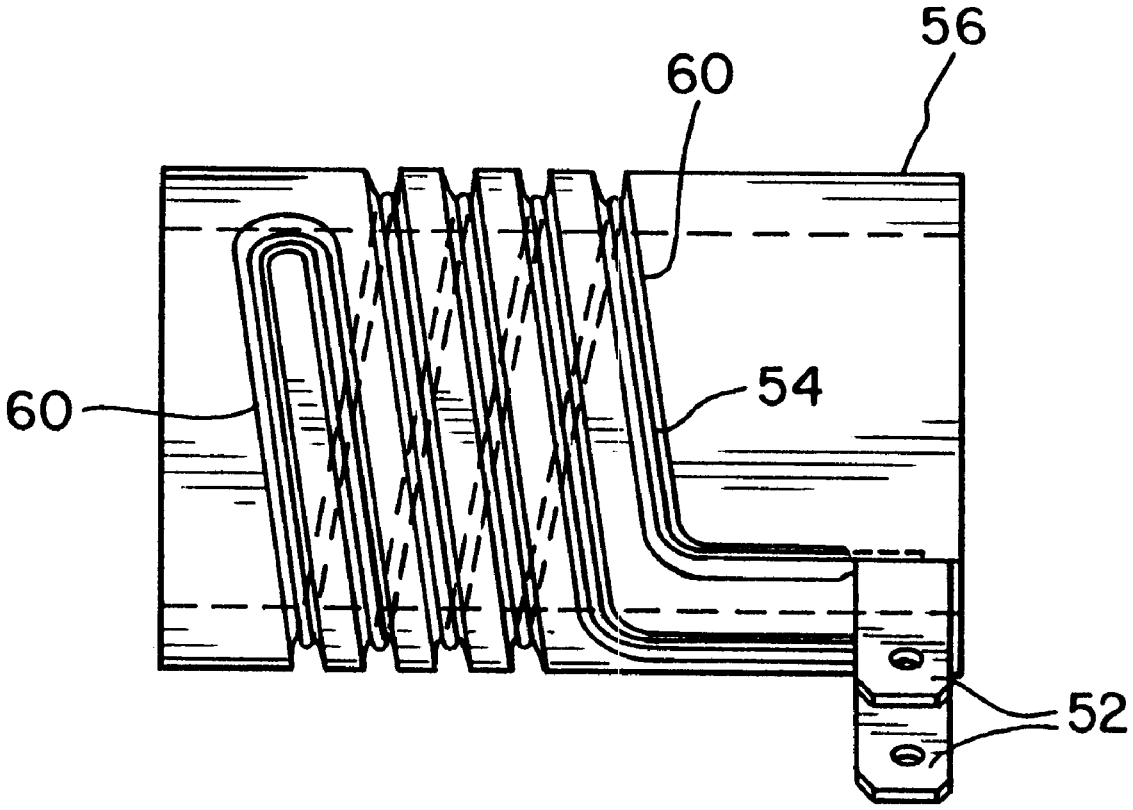
FIG. 6 is a side view of the body and heater of the heater assembly of FIG. 5.

Referring now to FIGS. 5 and 6, there is shown another embodiment of a heater assembly 50 of the present invention. Heater assembly 50 is similar to heater assembly 12 in that it includes terminals 52 which are attached to opposite ends of a resistance heater wire 54, which in turn is overmolded within a body 56. However, body 56 includes a bore 58 which is not disposed around a fluid line, but rather directly carries the fluid therein which is to be heated. Moreover, resistance heater wire 54 and terminals 52 are not first placed on a tree and thereafter placed as an assembly within a mold to be overmolded. Rather, body 56 is formed with a continuous spiral groove 60 at the periphery thereof which receives each of resistance heater wire 54 and terminals 52 therein. An additional layer of plastic (not shown) having a suitable thickness is injection molded over the periphery of body 56 after resistance heater wire 54 and terminals 52 are placed within groove 60, thereby making heater assembly 50 an integral unit with resistance heater wire 54 embedded therein. Heater assembly 50 is suitable for use with an automatic ice maker unit 16, as described above with reference to heater assembly 12. Since heater assembly 50 directly carries the water, it would also of course be connected to fluid coupling 20 (or other suitable structure) to receive the water from the external source.

In the embodiments of heater assemblies 12 and 50 described above, the respective heater assemblies are used to prevent water used in an automatic ice maker unit from freezing inside the freezer. However, it will be appreciated that the present invention as illustrated, e.g., by heater assemblies 12 and 50 may be used with other applications. For example, the present invention may be used in conjunction with a water supply line for a water filter in a water dispenser of a refrigerator. Other applications are of course possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluid transport assembly, comprising:

a fluid line for carrying a fluid therein, said fluid line having a top and a bottom; and a heater assembly including a body with a bore and two open ends respectively disposed at each end of said bore, said fluid line disposed within said bore and contacting said body, said heater assembly further including a heater and at least two electrical terminals connected with said heater, said heater disposed within said body and each said terminal extending from said body, said heater being configured to substantially heat only said bottom of said fluid line.

2. The fluid transport assembly of claim 1, wherein said heater comprises a resistance heater wire which is disposed with a predetermined pattern within said body.

3. The fluid transport assembly of claim 2, wherein said heater wire is disposed with a serpentine pattern within said body.

4. The fluid transport assembly of claim 1, wherein said heater comprises a resistance heater wire and said at least two terminals comprise two terminals which are respectively connected to opposite ends of said heater wire.

5. The fluid transport assembly of claim 1, wherein said heater assembly is manufactured by the process of placing said heater within an injection mold and overmolding said heater within said mold with a plastic material.

6. The fluid transport assembly of claim 1, wherein said bore is a cylindrical bore with a first taper and said fluid line has a second taper, said first and second tapers being complementary.

7. The fluid transport assembly of claim 1, said heater assembly further comprised of a plastic tree disposed therein, and wherein said heater is comprised of a resistance wire and said resistance wire is carried by said tree.

8. A heater assembly, comprising:

a body with a bore through which a fluid is transported and two open ends respectively disposed at each end of said bore, said body having at least one groove therein;

a heater disposed within said at least one groove in said body; and at least two electrical terminals connected with said heater, each said terminal extending from said body.

9. The heater assembly of claim 8, wherein said bore is configured to directly carry the fluid therein.

10. The heater assembly of claim 8, further comprising a fluid line disposed within said bore and contacting said body, said fluid line being configured for carrying the fluid therein and thereby transporting the fluid through said bore.

11. The heater assembly of claim 8, wherein said heater comprises a resistance heater wire which is disposed with a predetermined pattern within said at least one groove in said body.

12. The heater assembly of claim 11, wherein said heater wire is disposed with a helical wound pattern within said body.

13. The heater assembly of claim 11, wherein said heater wire is disposed with a serpentine pattern within said body.

14. The heater assembly of claim 8, wherein said heater comprises a resistance heater wire and said at least two terminals comprise two terminals which are respectively connected to opposite ends of said heater wire.

15. The heater assembly of claim 8, wherein said heater assembly is manufactured by the process of placing said heater within an injection mold and overmolding said heater within said mold with a plastic material.

16. The heater assembly of claim 8, wherein said bore is a cylindrical bore.

* * * * *